United States Patent [19]

Delet

[11] 4,153,062

[45] May 8, 1979

[54] BRASSIERE UNDERWIRE CONSTRUCTION AND METHOD

[76] Inventor: Victoria Delet, 60 W. 57 St., New York, N.Y. 10019

[21] Appl. No.: 902,680

[22] Filed: May 4, 1978

[51] Int. Cl.[2] ..... A41C 1/14

[52] U.S. Cl. ..... 128/476

[58] Field of Search ..... 128/465–477; 2/255–260

[56] References Cited

U.S. PATENT DOCUMENTS

| | | | |
|---|---|---|---|
| 531,684 | 1/1895 | Landenberger | 2/257 |
| 3,998,231 | 12/1976 | Delet | 128/476 |

*Primary Examiner*—Werner H. Schroeder
*Assistant Examiner*—Doris L. Troutman
*Attorney, Agent, or Firm*—Amster, Rothstein & Engelberg

[57] ABSTRACT

A brassiere underwire construction and method of making the same incorporating a U-shaped underwire portion and an extension portion with the extension portion overlaying the U-shaped portion and extending beyond the U-shaped portion.

5 Claims, 3 Drawing Figures

FIG. 1.
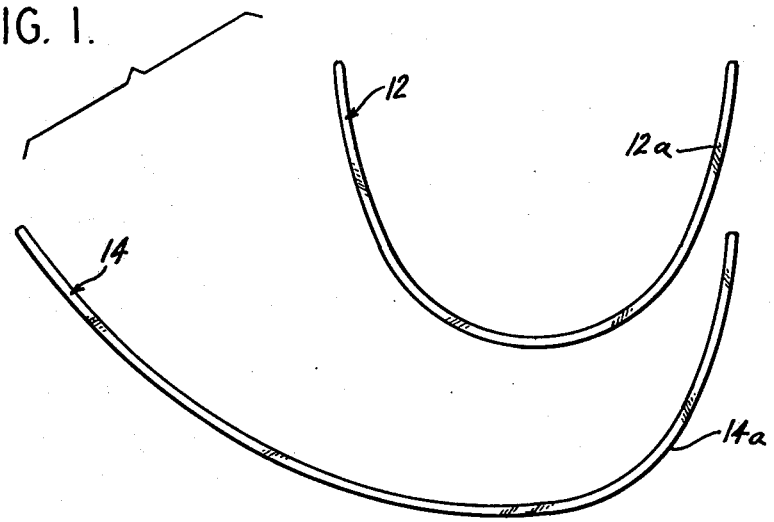
FIG. 2.
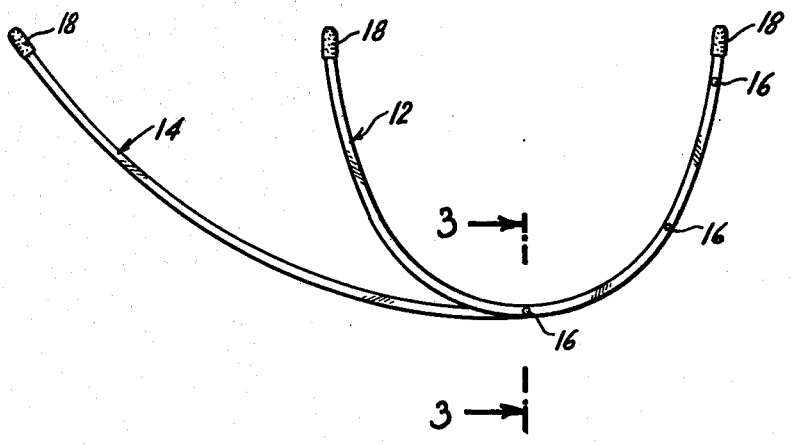
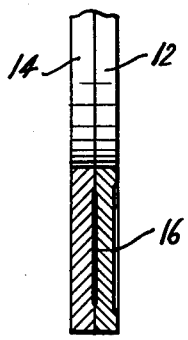
FIG. 3.

BRASSIERE UNDERWIRE CONSTRUCTION AND METHOD

This invention relates generally to brassieres and more specifically to a brassiere underwire and method of making the same.

Underwires used in brassieres are conventionally U-shaped wires which are secured beneath the brassiere bustcup to produce additional support for the wearer. These wires must be rigid enough, particularly in the plane of the brassiere, to provide adequate support for the bust and yet flexible enough, particularly in the transverse plane, to conform easily to the wearer's body for comfort and appearance.

U.S. Pat. No. 3,998,231 discloses a brassiere construction particularly useful in the manufacture of backless brassieres including a unique underwire arrangement which provides excellent support for the wearer without cumbersome back straps or midriff supports. That underwire incorporates a U-shaped underwire section which is secured at the bottom of each bustcup and an arcuate extension which extends outwardly from the lower portion of the cup under the wearer's arm.

While it would be possible to make underwires of a type described in the above-identified patent as a single unit from sheet material by a metal stamping operation, the shape of the underwire precludes efficient stamping since successive stampings cannot be nested within prior stampings for efficient utilization of material. As a consequence, the manufacture of the underwire of the above-identified patent by conventional stamping techniques would be very wasteful of relatively costly raw materials.

Further it may be desirable in manufacturing underwires of the type in question to be able to vary the flexibility of the various components of the underwire so that the U-shaped portion may be relatively more or less flexible than the underarm extensions. Stamping the underwire from a single sheet of material does not lend itself to such flexibility.

It is an object of the present invention to permit the manufacture of underwires for brassieres in a more efficient manner than heretofore available. A related object of the present invention is to permit the manufacture of such underwires with reduced waste of materials.

It is a further object of the present invention to provide a method of making brassiere underwires which is economical and which permits flexibility in determining the rigidity of the different portions of the underwire.

In accomplishing these and other objects in accordance with the present invention, underwires are manufactured by forming a semi-rigid U-shaped member dimensioned to be positioned under the bustcup in a brassiere; forming a second extension member conforming in part to a portion of the U-shaped member; overlaying the conforming portion of the extension member over the U-shaped member, and securing the U-Shaped member and extension member together so as to produce an underwire having a U-shaped section and an extension section extending from the lower portion of the U-shaped section, outwardly under the wearer's arm.

Further objects, features and advantages of the present invention will be more fully appreciated by reference to the following detailed description of a presently preferred but nonetheless representative embodiment thereof, when taken in conjunction with the appended drawings, wherein:

FIG. 1 is an exploded view of the two components of applicant's underwire prior to attachment;

FIG. 2 is a front view of applicant's assembled underwire; and

FIG. 3 is a cross-sectional view taken along line 3—3 in FIG. 2.

As seen in FIG. 1, applicant's underwire construction includes a U-shaped member 12 and an extension member 14. Members 12 and 14 may be stamped from a sheet of semi-rigid material such as spring metal. In stamping the individual components 12 and 14 separately, the stampings may be nested one within another as they are cut from the sheet so as to make most efficient use of the material. This is accomplished by preparing a die in conventional fashion, stamping the sheet material in a conventional stamping press of a type well known in the art and advancing the sheet material with each stamping so that each successive stamping is cut close to the prior stamping.

The U-shaped member 12 is dimensioned to fit beneath a bustcup in a brassiere. The extension member 14 is dimensioned so that one end of the extension member conforms to the dimension of a portion of the U-shaped member 12 with the opposite end of the extension member being dimensioned to extend beyond the U-shaped member when the conforming portions of the U-shaped and extension member are overlaid. As shown in FIG. 1, the right-hand section **14*a* of member 14 conforms to a half 12*a***, of the U-shaped member.

In manufacture, the two members are aligned one above the other and secured together by an appropriate technique, such as spot welding at spot weld points 16 shown in FIG. 2. Spot welding is accomplished in conventional fashion, for example, by the placing of electrodes at selected points 16 along the common area of the two components and passing an electric current between the electrodes which fuses the engaging metal portions between the electrodes forming a permanent weld. Cross-sectional view 3—3 shows portions of underwire 12 and extension member 14 at a weld point 16, showing the fused area between the underwire sections.

After assembly, the tip portions of the underwire may be covered with short rubber cushions 18 for wearer comfort and safety.

Extension member 14 preferably includes a substantial overlaying portion and, in the embodiment shown in the drawings, the overlaying portion extends over a full half section of the underwire 12 from one end thereof to the lower mid-point thereof. As shown, two components are secured together at three points 16 over this area, the points being approximately equidistanct from one another with the outermost points being adjacent the end of the underwire and the lowermost center portion of the underwire so as to provide firm attachment. In use, it is important that the securement between the U-shaped portion 12 and the extension portion 14 be rigid and secure without creating excessive bulk which may deface the appearance of the garment.

Further, by making the underwire from two separate pieces of material, by stamping or otherwise, it is possible to select the thickness and rigidity of each member in such a way that the underarm extension portion of the extension member may be more or less rigid than selected sections of the U-shaped part. For example, in a particular construction it may be desirable to have a relaively rigid U-shaped member but a less rigid extension member running under the arm. In this case, the U-shaped member can be fabricated of a relatively rigid material or made relatively thicker while the extension member can be relatively more flexible or thinner.

By manufacturing the underwire assembly in accordance with applicant's invention, applicant provides a light, sturdy unit which can be manufactured without wasting material and simultaneously permits the manufacturer the opportunity to control the relative stiffness of the various components of the underwire.

I CLAIM:

1. An underwire for use in a brassiere, said underwire comprising a semi-rigid U-shaped member dimensioned to be positioned under a bustcup in a brassiere, and a semi-rigid extension member, one side of said extension member conforming in dimension to a portion of the U-shaped member and overlaying said U-shaped member, the other side of said extension member extending away from the lower portion of said U-shaped member outwardly therefrom in position to extend under the wearer's arm and means securing said U-shaped member to said extension member in said overlaying area.

2. An underwire as defined in claim 1 wherein the conforming and overlying portion of said extension member extends substantially over one-half of said U-shaped member from one end thereof to the lower central portion thereof.

3. An underwire as defined in claim 1 wherein said U-shaped member and said extension member are spot-welded together.

4. An underwire as defined in claim 1 or 2 wherein said U-shaped member and said extension member have different degrees of flexibility

5. A method for manufacturing underwires for use in brassieres comprising steps of stamping a U-shaped member from a sheet of semi-rigid material, stamping an extension member from a sheet of semi-rigid material, a portion of said extension member conforming in dimension to a portion of said U-shaped member, overlying said conforming portions of said U-shaped member and said extension member and securing said U-shaped member and said extension member together in said overlying areas.

* * * * *